US006561113B2

(12) United States Patent
Leise

(10) Patent No.: US 6,561,113 B2
(45) Date of Patent: May 13, 2003

(54) WATER CRAFT MOORING DEVICE

(76) Inventor: Mark Leise, 7152 Longo Dr., The Colony, TX (US) 75056

( * ) Notice: Subject to any disclaimer, the term of this patent is extended or adjusted under 35 U.S.C. 154(b) by 0 days.

(21) Appl. No.: 09/776,256

(22) Filed: Feb. 2, 2001

(65) Prior Publication Data

US 2002/0104470 A1 Aug. 8, 2002

(51) Int. Cl.[7] ..... B63B 21/00

(52) U.S. Cl. ..... 114/230.15; 114/230.2; 114/221 R

(58) Field of Search ..... 114/230.1, 230.14, 114/230.15, 230.16, 230.17, 230.18, 230.19, 230.2, 221 R, 249, 250

(56) References Cited

U.S. PATENT DOCUMENTS

| | | | | | |
|---|---|---|---|---|---|
| 2,497,234 | A | * | 2/1950 | Mylie | 280/482 |
| 2,920,597 | A | * | 1/1960 | Dick | 114/230.17 |
| 2,938,492 | A | * | 5/1960 | Kulick | 114/203.18 |
| 2,956,531 | A | * | 10/1960 | Banker | 114/230.18 |
| 2,965,064 | A | * | 12/1960 | Wallace | 114/230.19 |
| 3,019,759 | A | * | 2/1962 | Woods | 114/230.17 |
| 3,108,563 | A | * | 10/1963 | Wurdack | 114/230.19 |
| 3,142,284 | A | * | 7/1964 | Kauffman | 114/230.15 |
| 3,224,404 | A | * | 12/1965 | De Jong | 114/230.25 |
| 3,406,651 | A | * | 10/1968 | Jalbert | 114/230.17 |
| 4,627,375 | A | * | 12/1986 | Davis et al. | 114/230.18 |
| 4,697,538 | A | * | 10/1987 | Day | 114/230.16 |
| 4,708,083 | A | * | 11/1987 | Billings | 114/230.17 |
| 4,913,078 | A | * | 4/1990 | Haverly | 114/221 R |
| 4,947,779 | A | * | 8/1990 | Grinde | 114/250 |
| 4,977,846 | A | * | 12/1990 | Landa et al. | 114/230.19 |
| 5,036,787 | A | * | 8/1991 | Rogers | 114/230.17 |
| 5,188,054 | A | * | 2/1993 | Jacobs, Jr. | 114/250 |
| 5,243,926 | A | * | 9/1993 | Wright et al. | 114/230.19 |
| 5,398,634 | A | * | 3/1995 | Eagan | 114/230.1 |
| 5,499,591 | A | * | 3/1996 | Chippas | 114/230.15 |
| 5,575,234 | A | * | 11/1996 | Dysarz | 114/230.27 |
| 5,634,421 | A | * | 6/1997 | Velarde | 114/230.15 |
| 5,671,693 | A | * | 9/1997 | Robinson | 114/230.1 |
| 5,676,085 | A | * | 10/1997 | Michl, Jr. | 114/230.1 |

* cited by examiner

*Primary Examiner*—S. Joseph Morano
*Assistant Examiner*—Ajay Vasudeva
(74) *Attorney, Agent, or Firm*—John E. Vandigriff

(57) ABSTRACT

A portable mooring device is adaptable for attachment to existing devices, such as cleat or rail, or directly to a boat or other water craft. A flat plate is attached directly to the water craft or to an existing cleat or rail, and then an attachment device is attached to the plate. The attachment device may be a mounting plate that receives a rod secured thereto by a pin or other fastening device. The rod may be of a desired length to secure the water craft to a dock with a rope or other securing device. The rod is secured in the mounting plate so that it will not move laterally to the dock, therefore keeping the watercraft at a desired distance from the dock and preventing the water craft from hitting and rubbing against the dock, or other water craft. The rod may have a pivot point on the end attached to the mounting plate so the boat can move up and down with the movement of the water.

15 Claims, 6 Drawing Sheets

WATER CRAFT MOORING DEVICE

FIELD OF THE INVENTION

The invention relates to water craft mooring devices, and more particularly to a portable or built-in mooring device for mooring a boat or other water craft to a dock, or to another water craft.

BACKGROUND OF THE INVENTION

In mooring boats and other water craft to a dock, various types of mooring devices have been developed. The simplest mooring device is a rope that is tied to both the boat and dock. However, when the water is turbulent, this simple device, as with some other mooring devices, allows the boat to rub against the dock, particularly when there is a storm, or when other water craft pass near the moored water craft, this causes the water to move up and down incurring damage to the water craft as it hits the dock with the up and down motion of the water. Buoy type bumpers are pushed up or down by the waves, allowing the boat to come in contact with the dock, or the mooring device itself could rub and damage the water craft.

U.S. Pat. No. 5,575,234, shows a mooring device that is comprised of two elongated arms that are attached to the boat at one point and to the dock at two points to allow the boat to move up and down, but not against the dock.

U.S. Pat. No. 4,697,538, utilizes two arms and a ball and hitch socket for mooring a boat to a dock. The ball is attached to the boat, and the hitch socket is attached to one of the arms attached to the dock.

Reissue Pat. No. RE25,372 utilizes two pivotally attached mooring arms. Each end of each.arm is attached to a bracket, one end is attached to the boat and one end is attached to the dock.

The prior art mooring devices each require a permanent attachment to a dock, therefore, the mooring devices are not portable or adaptable for attachment to existing devices on a boat or on another dock without matching hardware.

SUMMARY OF THE INVENTION

The invention is a portable mooring device that is adaptable for attachment to existing devices, such as a cleat or rail on a boat or water craft. A flat plate is attached to an existing cleat or rail by U-bolts, and then a mounting fixture or mounting device is attached to the plate. The attachment device may be a mounting plate that receives a rod secured thereto by a pin or other fastening device. The rod may be of a desired length to secure the boat to a dock with a rope, cord, or other securing device. The rod is secured in the mounting plate so that it will not move laterally to the dock, therefore keeping the boat at a desired distance from the dock. The rod may have a pivot point on the end attached to the mounting plate so the boat can move up and down with the movement of the water.

DESCRIPTION OF A PREFERRED EMBODIMENT

Figure 1:
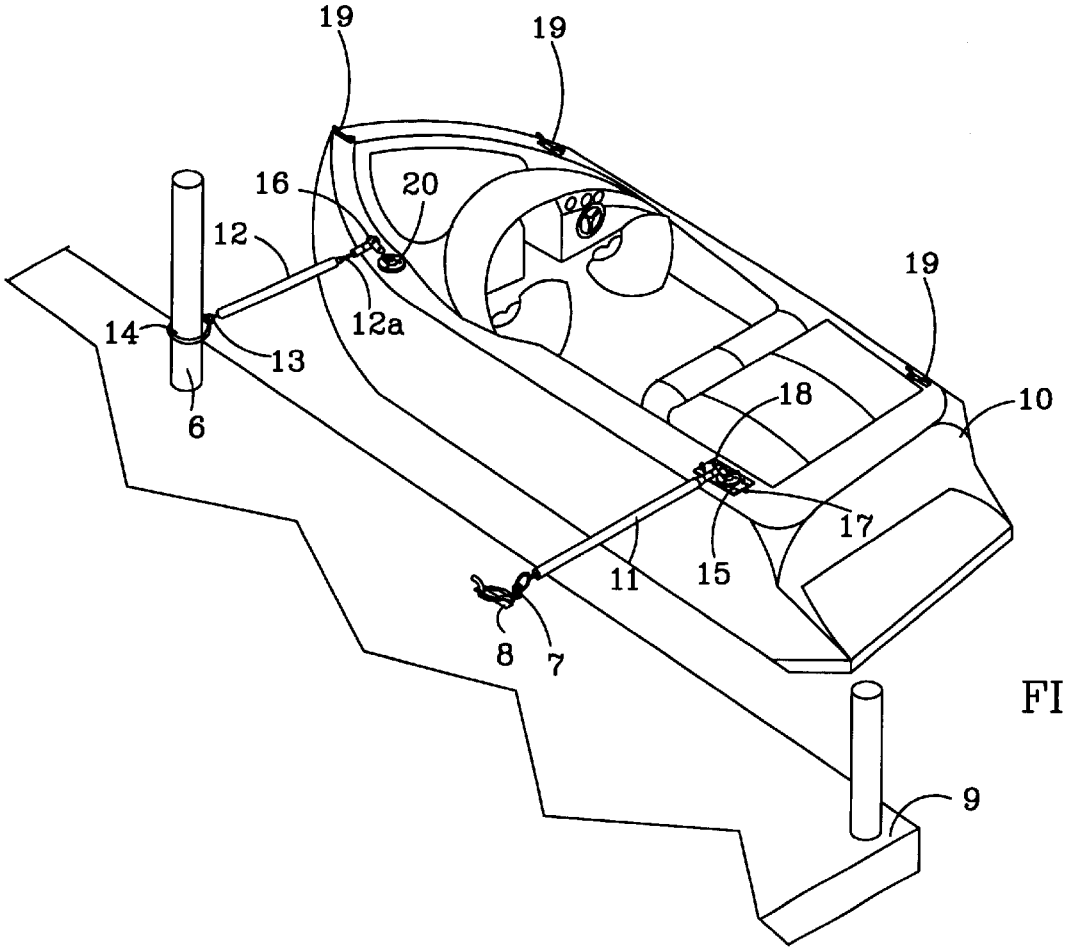
FIG. 1 shows a boat secured to a dock with a pair of portable mooring devices according to the invention.

The invention is a portable mooring device for mooring a boat or water craft to a dock, or to another water craft. FIG. 1 shows a boat 10 moored to a dock 9 by mooring devices 11 and 12. Mooring device 11 is attached to a cleat 8 by rope or elastic cord 7 on dock 9. The other end of mooring device 11 is attached to boat 10 by a attachment device assembly 15, described in detail (FIGS. 2–4) below, that is attached to an existing cleat or rail on boat 10.

Figure 8A:
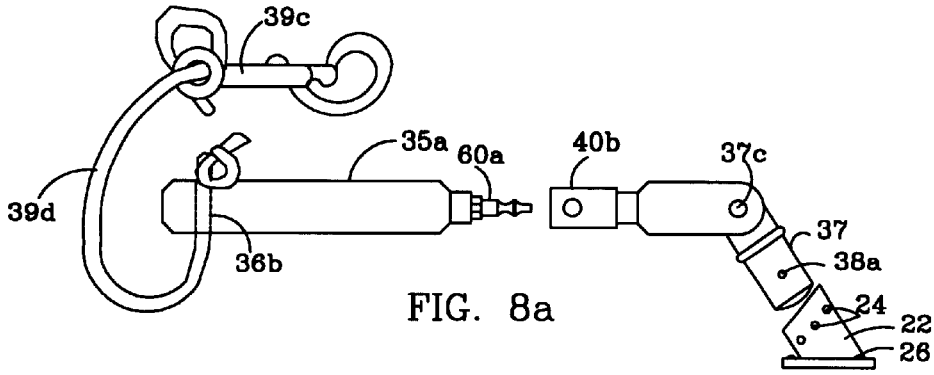
FIG. 8*a* shows a two piece mooring device with a quick disconnect connector.

The other mooring device or rod 12 is attached at one end to a post 6 on dock 9 by a cord 14 tied through an eyelet 13, or attached through a drilled hole in rod 12. Mooring device 12 is connected to a mooring fixture device 20 by quick disconnect end 12*a* of mooring device 12, and by pivot device 16 which connects to mooring plate 20. Pivot device 16 allows for movement of the boat up and down. The details of mooring device 12 with quick disconnect end 12*a* is described in more detail below (FIG. 8*a*).

A standard boat cleat 19 is shown at the front of boat 10 (FIG. 1). Cleats such as cleat 19 are usually mounted on the sides, back and front of the boat. Utilizing these cleats, the invention can be attached to a boat without any drilling or other permanent attachment to the boat. Alternately, a mooring fixture device 20 may be permanently attached to the boat, eliminating the universal cleat mounted plate 18(FIG. 2).

Figure 2:
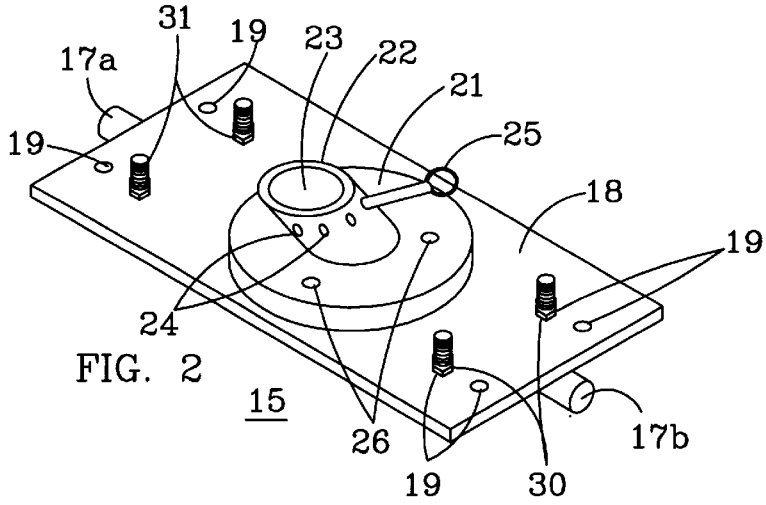
FIG. 2 shows an attachment device attached to a mounting fixture attached to a universal plate and then to a boat cleat.
Figure 3:
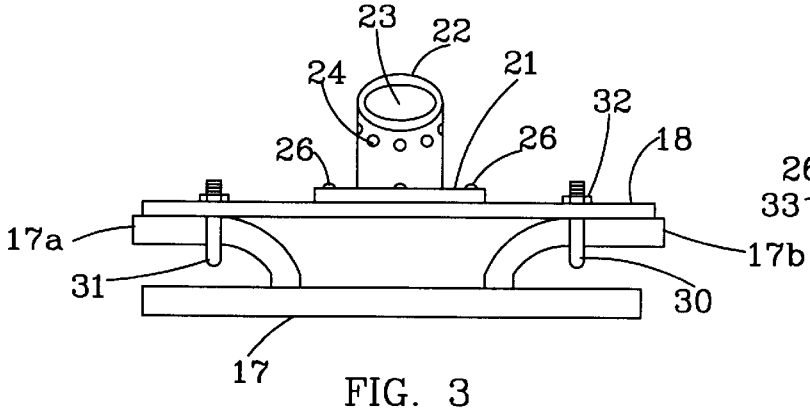
FIG. 3 is a side view of the mounting fixture secured to the flat plate which is secured to a cleat with U-bolts.

FIG. 2 illustrates an attachment device assembly 15 which is attached to cleat 17 (FIG. 3). Plate 18 is attached to ends 17*a* and 17*b* of cleat 17 by U-bolts 30 and 31 which are inserted through pair of a plurality of pairs of holes 19 through plate 18. Having a plurality of holes 19 allows mounting to several sized of cleats. Mooring fixture device 21 is secured to plate 18 by welding, screws or rivets 26. Mooring plate 21 has a hollow tube structure 22, with opening 23, for receiving the pivot end 16 of a mooring device 12 (FIG. 1). Tube 22 has a series of holes 24 around its outside, holes 24 extending through the wall of tube 22, and holes on opposite side of tube 22 are aligned with each other. A pin 25 is inserted through aligned holes 24 and through the end of, for example, a pivot device 16, prevents the secured pivot device from pivoting in mooring plate 21, and holds the water craft parallel to the dock, or another water craft.

FIG. 3 is a side view of attachment device assembly 15 showing plate 18 secured to cleat 17 with U-bolts 30 and 31 extending around the ends 17*a* and 17*b* of cleat 17 and up through holes 19 in plate 18. A different pair of holes 19 may be used, depending upon the size of cleat 17. Mooring plate 21 is attached to plate 18 by screws or rivets 26.

Figure 4:
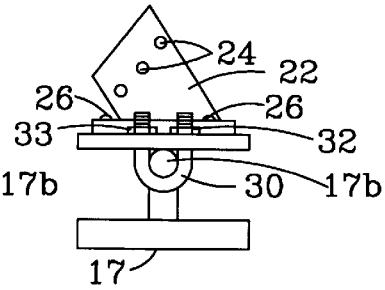
FIG. 4 is a end view of FIG. 3.

FIG. 4 is an end view of attachment plate assembly. This view shows U-bolt 30 around cleat end 17*b,* and the two ends of U-bolt 30 extend upward through plate 18, and secure there by nuts 32 and 33. Tube 22 is shown extending upward at an angle, however, it could extend vertically upward since a pivot attachment device may be inserted into tube 22 at either angle, and secured within opening 23 with a pin 25 (FIG. 2).

Figure 5:
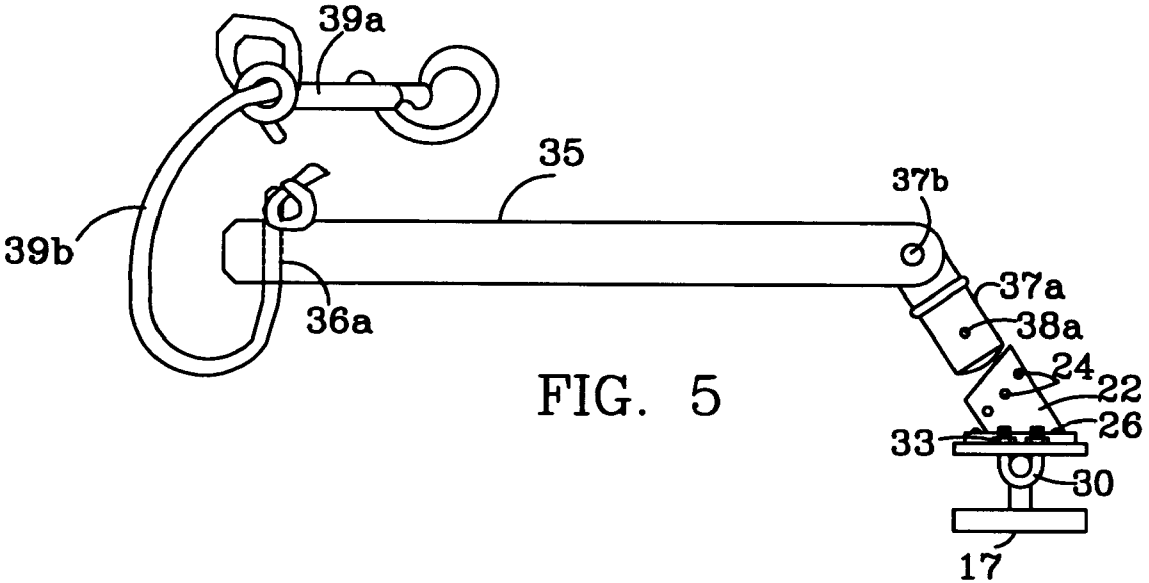
FIG. 5 shows a mooring device rod and a swivel end connected by a pin or bolt.

FIG. 5 shows in more detail a mooring device 35 that has an opening 36*a* on one end. A rope, cord or chain 39*b,* with a fastener 39*a,* may be inserted though opening 36*a* to attach one end of mooring device 35 to a dock, or to a cleat on another water craft. Mooring device has on the other end a section 37*a* pivotally secured to device 35 by a pin 37*b*. Section 37*a* is placed in tube 22 and secured therein by a pin (not illustrated) that extends through opening 38*a* in section 37*a* and one of the aligned set of openings 24 in tube 22.

Figure 6:
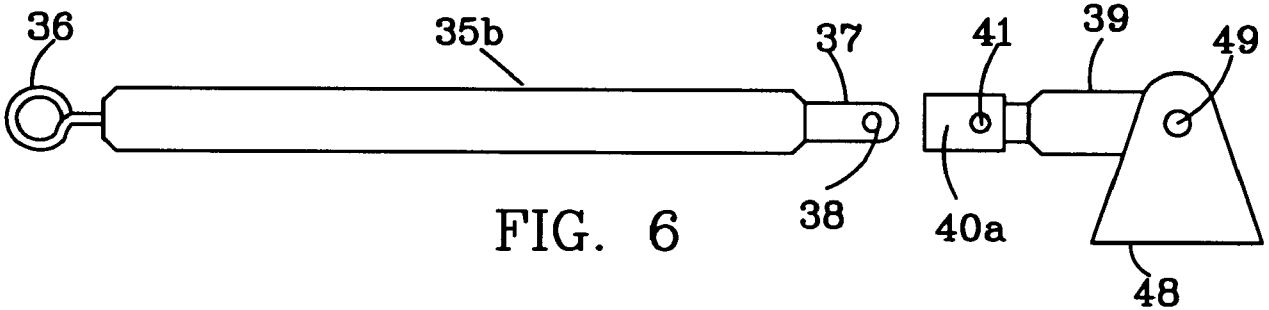
FIG. 6 shows the mooring device rod and a bracket mount end.
Figure 7:
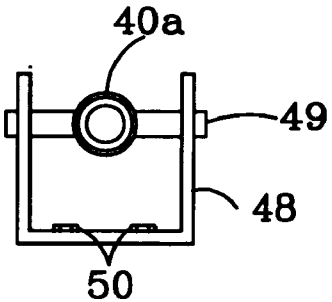
FIG. 7 an end view of FIG. 6.

FIG. 6 shows a different mooring device 35*b* with a pivot device attached to a different mount 48. The pin-mount holes 38 and 41 extend, respectively, through reduced end 37 and tube 40*a*. Pivot device 39 is mounted in bracket 48 and held in place by pin 49. Pivot device 39 may rotate upward and downward on pin 49 within bracket 48. Bracket 48 may be secured, for example, to plate 18 (FIG. 2) by two or more bolts 50, as shown in FIG. 7. When using bracket 48, a plate 18 is not needed (FIG. 2). Bracket 48 has mounting holes in the bottom of the bracket to secure it to cleats using U bolts.

Figure 8:
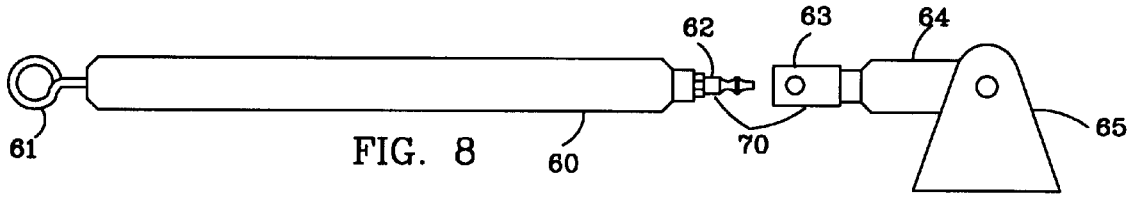
FIG. 8 shows the mooring device rod with a quick disconnect connector attached to a bracket mount.
Figure 9:
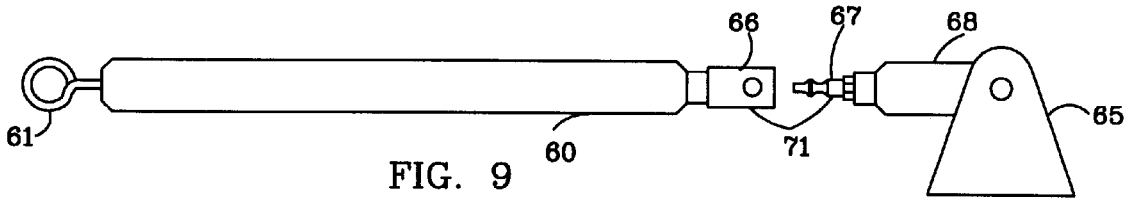
FIG. 9 shows the device of FIG. 8 with the quick disconnect ends interchanged.

FIG. 8 illustrates a mooring device 60 with an eyelet or hole on one end and a first mating part 62 of a quick disconnect device 70 on the other end. The second mating part 63 of quick disconnect device 70 is connected to swivel connector 64. Swivel connector 64 is similar to pivot device 39 of FIG. 6, and is connected to bracket 65. FIG. 9 shows the two ends 66 and 67 of a quick disconnect device 71 reversed so that the female end 67 is attached to a pivot device 68 instead of an end of mooring device 60.

FIG. 8*a* shows a combination of the features of FIG. 5 the mooring device rod 35*a* having a cord 39*d* extend through the end of the rod at 36*b* and having a snap fastener 39*c* on cord 39*d*. Rod 35*a* has a male part 60*a* of the quick disconnect connector. The female part of the quick disconnect 40*b* is connected to a part 37 by pin 37*c*. Part 37 may be mounted in tube 22 and secured to a surface by bolts or screws 26. Part is retained in tube 22 by a pin (not illustrated) that is inserted through aligned holes 24 and opening 38*a*.

Figures 10, 11:
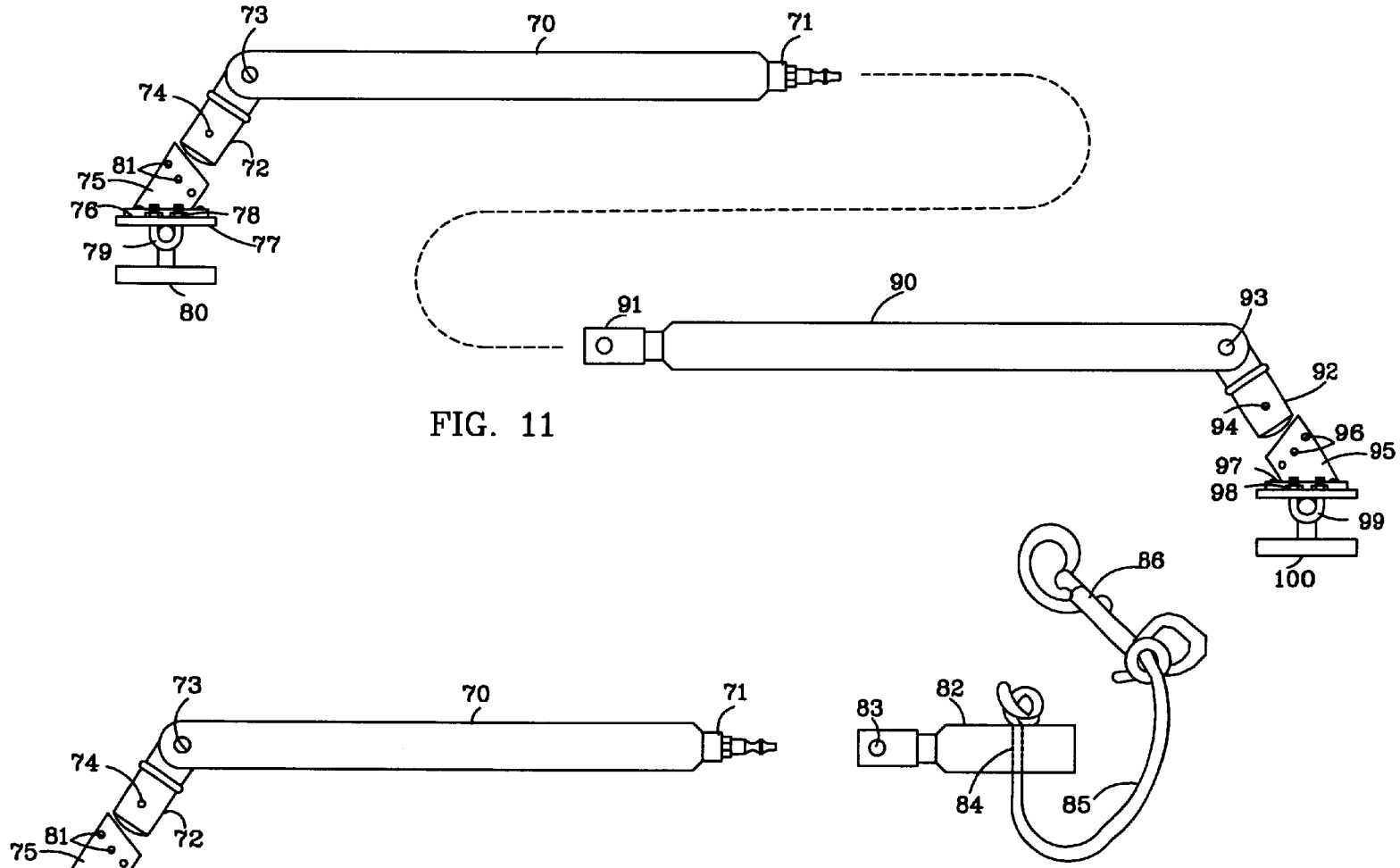
FIG. 10 shows a mooring device with a quick disconnect connector connected to a tie line.
FIG. 11 shows two mooring devices that may be connected together by a quick disconnect connector.

FIG. 10 shows a mooring device 70 with a quick disconnect end 71 and a second pivotally attached end 72 attached to device 70 by a pin 73. End 72 is mounted in tube 75 with fixture device 76, which is mounted on a water craft cleat 80 by U-bolt 79 and plate 77. The second part 82 of the quick disconnect connector has an end 83 into which is inserted end 71. Connector 82 has an opening 84 through which is secured a cord 85 connected to a fastener 86.

FIG. 11 shows two mooring devices 70 and 90 which may be used to connect two water craft together. The two are the same, except device 90 has the female part of the quick disconnect connector 91 and device 70 has the male part of the a quick disconnect connector 71. Device 90 is pivotally connected to part 92 by a pin 93, and part 92 is secured in tube 95 which is mounted on cleat 100 by a mounting plate 98 and U-bolt 99.

Figure 12:
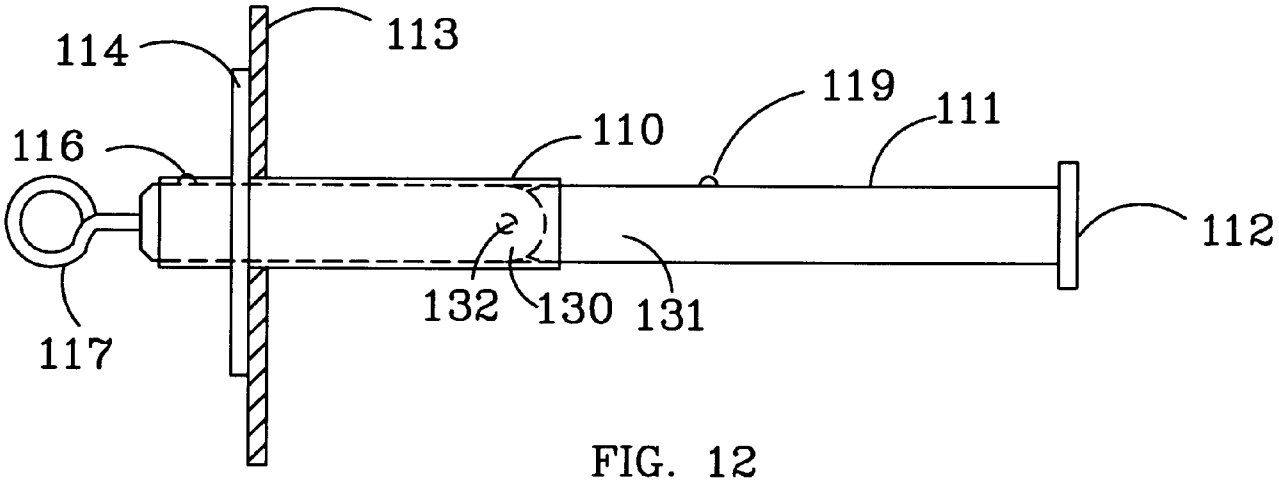
FIGS. 12 and 13 illustrate a hull mounted mooring device in retracted and extended positions.
Figure 13:
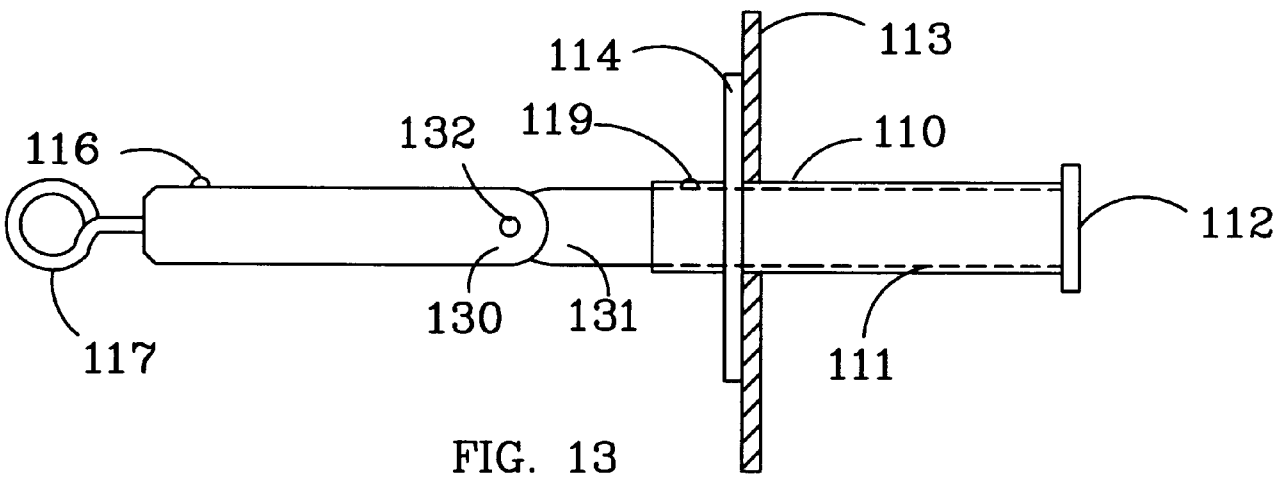

FIGS. 12 and 13 illustrate a mooring device that may be built-in or installed in the boat at time of manufacture, or at a later time. Mooring device 110 is mounted through the side 113 of a water craft. It is held in place by securing plate 114 to the side of the water craft. An internal rod ill slides in and out of device 110 and is locked in the closed position by ball latch 116. By pressing downward on ball latch 116, rod 111 may be pulled out of device 110 and locked in place by ball latch 119. Plate 112 prevents rod from being pulled out of device 110. Eyelet 117 may be red to a cord and to a dock or other water craft. Ball latch holds rod 111 in an extend position as shown in FIG. 13

Rod 111 may have a pivot joint made up of ends 130 and 131 joined by a pin 132. This allows the water craft to move up and with waves.

As in the mooring devices described in FIGS. 8–11, eyelet 117 be replaced by a quick release fastener.

The invention is a portable mooring device that can moor a water craft to a dock or to another water craft, and to protect the water craft from docking apparatus when docking or connecting to dock, or another water craft.

What is claimed is:

1. A mooring apparatus for mooring a water craft to a dock, another water craft, and mooring locations, comprising:

a portable rod for extending between the water craft and its mooring location;

a connecting device on a first end of said rod for attaching the first end of the rod to the mooring location;

a mooring fixture having differently-shaped interchangeable parts, each of said interchangeable parts being adapted for attachment to a different mooring apparatus on water craft; and a disconnect device on a second end of said rod for attaching to said mooring fixture.

2. The mooring apparatus according to claim 1, wherein said mooring fixture connects to one of a cleat and rail on the water craft.

3. The mooring apparatus according to claim 1 wherein said mooring fixture is attachable to one of a cleat, rail, and water craft surface.

4. The portable mooring apparatus according to claim 1, wherein said disconnect device on the second end has a pivot joint.

5. The portable mooring apparatus according to claim 1, including a quick disconnect connector between said rod and said mooring fixture.

6. The portable mooring apparatus according to claim 1, wherein the mooring fixture for attaching to a boat has a connector pivotally attached thereto.

7. A mooring apparatus for water craft, comprising:

a portable rod for extending between a water craft and a dock;

an opening on a first end of said rod for attaching the first end of the rod to the dock with a cord;

a mooring fixture having differently-shaped interchangeable parts, each of said interchangeable parts being adapted for attachment to a different mooring apparatus on water craft; and a disconnect end on a second end of said rod with a pivot section for attaching to said mooring fixture.

8. The portable mooring apparatus according to claim 7, wherein said portable rod connects to one of a cleat and rail on the water craft, and another water craft.

9. The portable mooring apparatus according to claim 7 wherein said mooring fixture includes a base plate, and fastening means for attaching said base plate to one of a cleat, rail, and directly to the water craft.

10. The portable mooring apparatus according to claim 7, wherein said disconnect device on the second end of said rod has a pivot joint.

11. The portable mooring apparatus according to claim 7, including a quick disconnect connector between said rod and said mooring fixture.

12. The portable mooring apparatus according to claim 7, wherein the mooring fixture for attaching to a boat has a connector pivotally attached thereto.

13. A mooring apparatus for water craft, comprising:

a portable rod for extending between a first water craft and at least one of a dock and a second water craft;

a first attachment device on a first end of said rod for attaching the first end of the rod to one of said second water craft and a dock;

a mooring fixture, including a plate and a second attachment device for connecting to said rod, for attaching to said first water craft; said, mooring fixture having differently-shaped interchangeable parts, each of said interchangeable parts being adapted for attachment to a different mooring apparatus on water craft; and a disconnect device on at least one of said first end and second end of said rod with a pivot section.

14. A mooring apparatus for mooring a water craft to a dock, another water craft, and mooring locations, comprising:

a portable rod device for attaching to the water craft, said rod extending between the water craft and the mooring location, and said portable rod pivotally attachable to said water craft and may be folded back onto itself for storage within the watercraft;

a connecting device on a first end of said rod for attaching the first end of the rod to the mooring location;

a mooring fixture for attaching to the water craft; and a disconnect device on a second end of said rod for attaching to said mooring fixture.

15. The mooring apparatus according to claim 14, wherein said rod device includes a tube mounted on said water craft, said rod movable into and out of said tube.

* * * * *